US009670742B2

(12) United States Patent
Anderson

(10) Patent No.: US 9,670,742 B2
(45) Date of Patent: Jun. 6, 2017

(54) DOWNHOLE STABILIZER

(71) Applicant: Charles Abernethy Anderson, Millarville (CA)

(72) Inventor: Charles Abernethy Anderson, Millarville (CA)

( * ) Notice: Subject to any disclaimer, the term of this patent is extended or adjusted under 35 U.S.C. 154(b) by 197 days.

(21) Appl. No.: 14/400,514

(22) PCT Filed: Mar. 21, 2013

(86) PCT No.: PCT/CA2013/050233
§ 371 (c)(1),
(2) Date: Nov. 11, 2014

(87) PCT Pub. No.: WO2014/138844
PCT Pub. Date: Sep. 18, 2014

(65) Prior Publication Data

US 2015/0129309 A1 May 14, 2015

Related U.S. Application Data

(60) Provisional application No. 61/800,127, filed on Mar. 15, 2013.

(51) Int. Cl.

| | |
|---|---|
| ***E21B 17/10*** | (2006.01) |
| ***E21B 3/00*** | (2006.01) |
| ***E21B 10/30*** | (2006.01) |
| ***E21B 17/042*** | (2006.01) |

(52) U.S. Cl.
CPC ..... *E21B 17/1078* (2013.01); *E21B 3/00* (2013.01); *E21B 10/30* (2013.01); *E21B 17/042* (2013.01); *E21B 17/1057* (2013.01); *E21B 17/1064* (2013.01)

(58) Field of Classification Search
CPC ..... E21B 17/1057; E21B 17/1064; E21B 17/1078; E21B 10/30
USPC ..... 166/241.3; 175/325.3
See application file for complete search history.

(56) References Cited

U.S. PATENT DOCUMENTS

| | | | | |
|---|---|---|---|---|
| 3,400,773 A * | 9/1968 | Castela | E21B 10/28 | 175/107 |
| 3,971,450 A * | 7/1976 | Fox | E21B 4/003 | 175/107 |
| 4,156,374 A * | 5/1979 | Shwayder | B23P 6/00 | 175/325.2 |
| 2004/0026131 A1* | 2/2004 | Boulet | E21B 17/1064 | 175/325.3 |

* cited by examiner

*Primary Examiner* — George Gray
(74) *Attorney, Agent, or Firm* — Scott T. Griggs; Griggs Bergen LLP

(57) ABSTRACT

A stabilizer for use in a wellbore string, the stabilizer having an elongate body having an upper end for connection to the wellbore string and a lower end for connection to a wellbore string, a long axis between the ends and an outer surface; and a first cutting ring mounted on the elongate body and exposed on the outer surface with an annular outer surface of the first cutting ring encircling the elongate body.

26 Claims, 2 Drawing Sheets

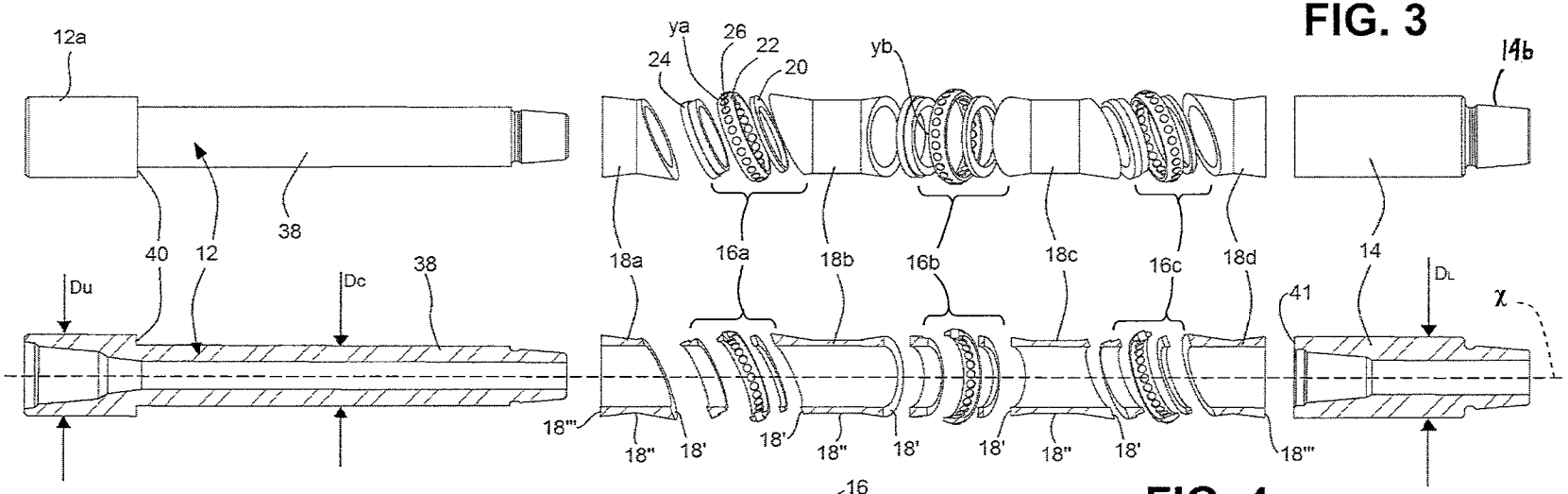
FIG. 3
FIG. 4
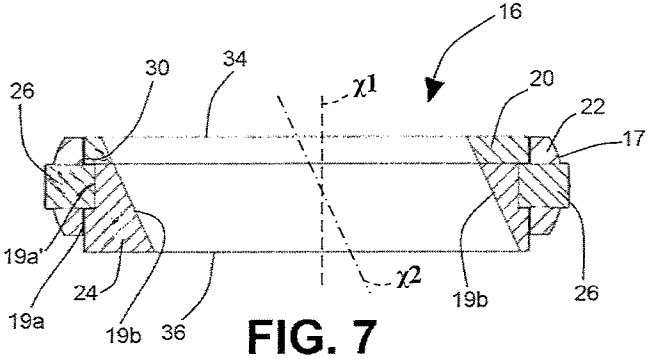
FIG. 7
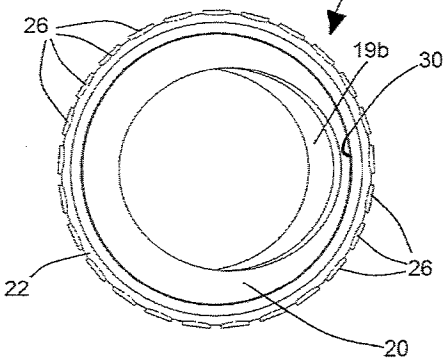
FIG. 6
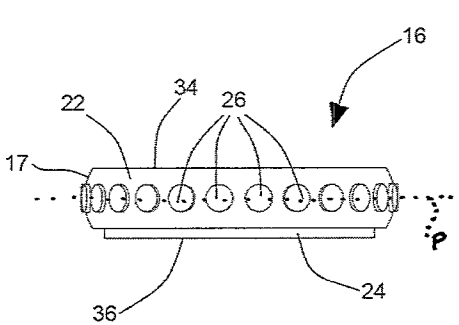
FIG. 5

DOWNHOLE STABILIZER

FIELD

The invention relates to a stabilizer for well drilling operations.

BACKGROUND

In the oil field, when drilling for oil and gas, stabilizers are used to centralize the drill string and, in particular, the bottom hole assembly of the string in which the stabilizer is connected.

There are various types of stabilizers such as spiral blade stabilizers with a number of spirally oriented blades extending out from the main body or roller stabilizers, also called roller reamers, with a number of axial rollers mounted on the main body. These stabilizers have various drawbacks.

SUMMARY

In accordance with a broad aspect of the present invention, there is provided a stabilizer for use in a wellbore string, comprising: an elongate body having an upper end for connection to the wellbore string and a lower end for connection to a wellbore string, a long axis between the ends and an outer surface; and a first cutting ring mounted on the elongate body and exposed on the outer surface with an annular outer surface of the first cutting ring encircling the elongate body, the first cutting ring has a plane defined through the annular outer surface and is installed with the plane at a non-orthogonal angle relative to the long axis.

In accordance with another broad aspect of the present invention, there is provided a method for stabilizing a drill string in a wellbore, the method comprising: running in a drill string with a stabilizer, the stabilizer including an elongate body having an outer surface, an upper end connected to an upper portion of the drill string and a lower end connected to a lower portion of the drill string, a long axis between the ends substantially coaxial with an axis of rotation of the drill string; and a first cutting ring mounted on the elongate body and exposed on the outer surface with an annular outer surface of the first cutting ring encircling the elongate body, the first cutting ring has a plane defined through the annular outer surface and is installed with the plane at a non-orthogonal angle relative to the long axis; and supporting the drill string in the wellbore with the first cutting ring bearing via a plurality of contact points against a wall of the wellbore.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Drawings are included for the purpose of illustrating certain aspects of the invention. Such drawings and the description thereof are intended to facilitate understanding and should not be considered limiting of the invention. Drawings are included, in which:

FIG. 3 is an exploded view of the stabilizer in FIG. 1;

FIG. 4 is a cross-sectional view along a central axis of the stabilizer in FIG. 3;

FIG. 5 is a side view of an embodiment of a cutting ring and bearing assembly for use with the stabilizer of the present invention;

FIG. 6 is a plan view of one face of the cutting ring and bearing assembly of FIG. 5; and FIG. 7 is a cross-sectional view along a center axis of the cutting ring and bearing assembly of FIG. 5.

DETAILED DESCRIPTION OF VARIOUS EMBODIMENTS

Figures 1, 2:
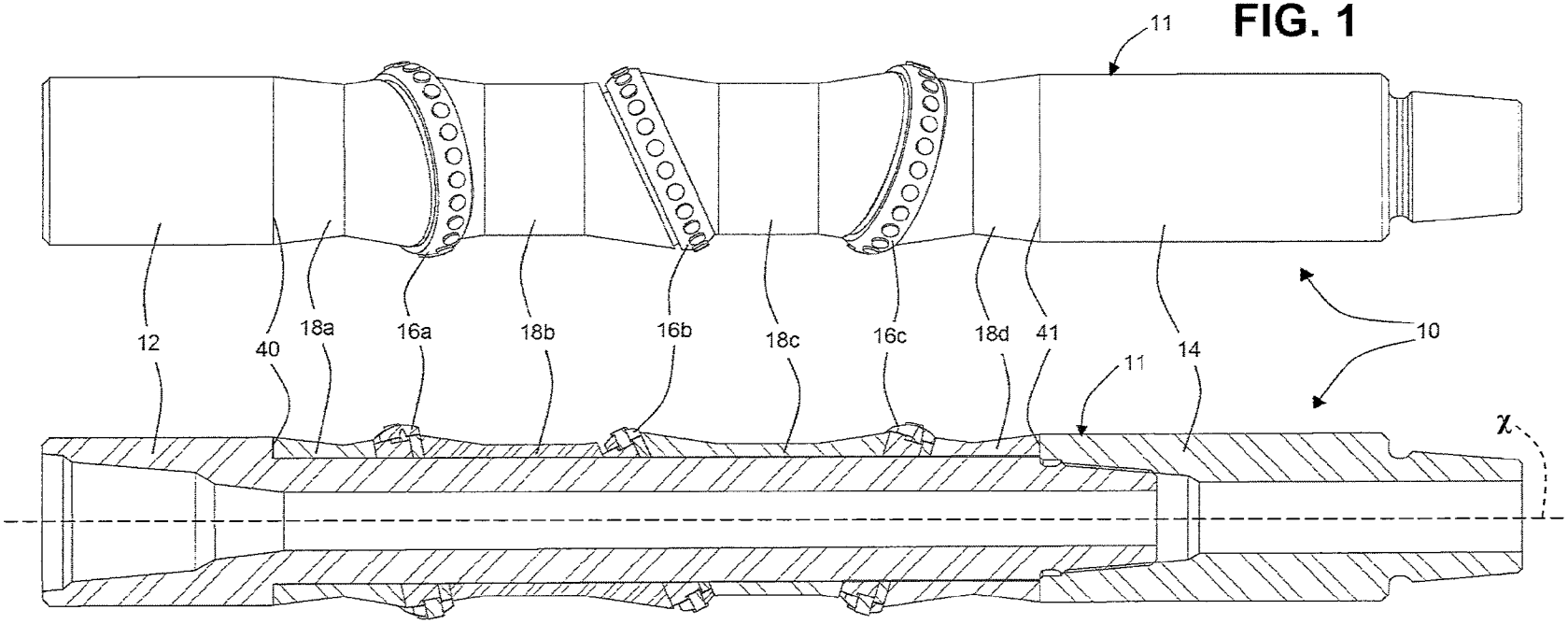
FIG. 1 is an elevation view of an embodiment of a stabilizer of the present invention.
FIG. 2 is a cross-sectional view along a central axis of the stabilizer in FIG. 1.

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

In this disclosure, "up", "upper" or "above" generally denotes a position that is closer to surface than "down", "lower" or "below," when the stabilizer is situated downhole.

Referring to FIGS. 1 to 4, a stabilizer 10 for use in drilling operations comprises an elongate body 11 with one or more cutting rings 16*a*, 16*b*, 16*c* (sometimes collectively referred to as rings 16) mounted thereon. While a stabilizer with three rings 16*a*, 16*b*, 16*c* is illustrated, it is to be understood that any number of rings may be employed. Elongate body 11 includes a long axis x extending between its ends and an outer surface and rings 16 are exposed on the outer surface and encircle the body.

The outer surface in its entirety may be exposed on the stabilizer so that at any point about the circumference of the tool, it may be supported on one or more rings 16.

While one possible construction for a ring 16 is described in greater detail hereinafter, it is noted that annular outer surface 17 of each ring 16*a*, 16*b*, 16*c* includes a durable surface that is capable of resisting wear when in contact with the wellbore wall. In one embodiment, annular outer surface 17 is rendered durable by provision of a plurality of cutter heads 26. Rings 16 can protrude radially outwardly from the outer surface of the elongate body to bear against the wellbore wall during use.

Rings 16 can act as rollers on the stabilizer body. Each ring 16*a*, 16*b*, 16*c* can rotate around the long axis x of the elongate body. The rotation can be coaxial or off-axis relative to the long axis x of elongate body 11. Rotation that is off-axis can be about an axis parallel or nonparallel to the long axis x.

Rings 16 can be positioned in various ways with respect to orientation, location and spacing. In one embodiment, one or more of rings 16 may be positioned to encircle body 11 at any angle relative to the long axis x: orthogonally or non-orthogonally. In particular, if a plane is considered through the annular outer surface of a ring (for example, illustrated in FIG. 5, as plane P passing through all the cutter heads 26 in annular outer surface 17), that plane may be at any angle, for example from 10° to 90° (measured on the acute angle side), relative to the long axis while encircling the body of the stabilizer. Non-orthogonal ring orientations facilitate axial sliding movement of the stabilizer and also facilitate fluid flow past the stabilizer. Thus, in the illustrated embodiment as an example, each of rings 16 is installed at an angle relative to the long axis x, such that each ring's annular outer surface 17 is oriented in a non-orthogonal manner relative to the long axis x.

Elongate body 11 can take various forms. As is typical for drill string subs, elongate body may include ends formed for connection into the string, for example, such as by use of threaded pins and boxes. The body also may include, as typical, an inner bore extending between the ends.

In the illustrated embodiment, body 11 is formed to facilitate construction and operation of the stabilizer. For example, body 11 may include a multi-part form, the parts of which are connected during construction thereof. In this embodiment, body 11 includes a mandrel 12 forming one end and an end fitting 14 forming the other end.

In one embodiment, mandrel 12 has an end 12*a* formed for connection to other subs and a section 38 connected to end 12*a*. Section 38 has an outer diameter $D_C$. Outer diameter $D_C$ is smaller than the outer diameter $D_U$ at end 12*a*. In one embodiment, tool body sub 12 includes a shoulder 40 between end 12*a* and section 38. End fitting 14 has an outer diameter $D_L$, which is greater than outer diameter $D_C$. Because of the difference in diameters wherein $D_L > D_C$, a shoulder 41 is formed at the connection of mandrel 12 and end fitting 14.

Rings 16 can be installed on mandrel 12 and end fitting 14 can be attached to mandrel 12 to hold the rings in place.

While rings 16 may be installed in various ways on body 11, in this illustrated embodiment rings 16 may be retained on section 38 between shoulders 40, 41. Rings 16 rotate about section 38 on the elongate body.

While rotating about the long axis x, the center point of the cutting rings can intersect or be offset from the long axis of the body. Multiple variations of rings can be employed on the same tool: they need not be identical. Furthermore, the angular orientation of the rings can be varied, they need not all be oriented identically. For example relative to the long axis, some or all rings may be orthogonal and some or all rings may be non-orthogonally oriented. The non-orthogonal angle at which the rings are positioned relative to axis x can vary from ring to ring. For example, measuring on the acute side of the angle, the non-orthogonal angle at which the plane of each ring intersects the axis x is generally from 10° up to 90° and often between 20° and 70°.

In addition or alternately, the non-orthogonal angle at which the plane of each ring intersects the axis x can be parallel with all other rings or some or all rings can be angularly offset from the others. In one embodiment, the rings are each installed in a position rotated from at least some other rings on the tool such that the portion of each ring closest to end 12*a* may be offset from that portion of the other rings. For example, each ring, if offset from the others, may have a plane offset from the next ring by any angle but it may be roughly 360° divided by the number of rings on the stabilizer, which means the rings are offset by an angle of up to 180°. A three ring stabilizer as shown may, if desired, have rings offset from each other by about 100° to 140°. This provides that the rings are positioned, with supporting points spaced apart about 360° to support the stabilizer about its full circumference.

Spacers 18*a*, 18*b*, 18*c*, 18*d* (sometimes collectively referred to as spacers 18) may be employed for maintaining the cutting rings 16 at certain positions and orientations on body. Spacers 18 may each be a rigid, tubular member with an inner diameter ID that can be sleeved over section 38 and placed axially adjacent a ring. A spacer 18 can be positioned between adjacent rings (i.e. spacer 18*b* between rings 16*a*, 16*b*) or between a shoulder and a ring (i.e. spacer 18*a* between shoulder 40 and ring 16*a*). If employed, spacers 18, therefore, can maintain a minimum spacing between adjacent rings 16 or between one of the shoulders 40, 41 and a ring. While a stabilizer with four spacers is illustrated, it is to be understood that any number of spacers may be employed.

Spacers 18 may also be formed to particularly orient a ring. For example, one or both ends 18', 18''' of each spacer may be shaped to bear in a selected way against the surface upon which it is bear. As shown in the illustrated embodiment, some ends 18' may be slanted, cut non-orthogonally relative to the spacer's long axis (i.e. center axis relative to the inner diameter of the spacer) such that a surface is created against which a ring can be positioned to follow that non-orthogonal orientation.

If desired, spacers 18 and rings 16 may be installed closely in side-by-side relation between shoulders 40, 41, such that a sleeve-type structure of spacers and rings is formed on body. The spacers may be interlocked, for example, having ends 18' correspondingly shaped, as noted above, such that the interlocked spacers and rings on body 11 act in unison about the long axis x of the body. For example, the ends of adjacent spacers and rings may be similarly angled such that they tend to interlock rotationally and if one of the interlocked spacers or rings is engaged in a position on the mandrel, all interlocked parts are locked in a rotationally fixed position. Alternately, if rotation of the spacers and rings is desired about the mandrel, an interlock, if employed, ensures that the spacers and the rings all rotate together.

In one embodiment, shoulders 40, 41 bear against end spacers 18*a*, 18*d* and squeeze all the rings and the spacers together and against rotation about section 38.

The ends of the spacers bear against rings 16 or shoulders 40, 41 and should have a wall thickness to accept the force of these parts bearing thereagainst. Intermediate body portions 18" of the spacers between ends 18', 18''' may have a thinner wall thickness than at the ends. A transitional wall thickness increasing from thinner body portions 18" to the ends may take a conical form on the outer surfaces of the spacers.

A thinner wall may reduce the weight and material costs and may reduce the outer diameter of the spacers to form a fluid channel for enhanced fluid flow-by in use wherein the outer diameter of the tool is reduced at the channels relative to other areas, and thereby in use provides more annular space between the wellbore wall and the tool. Further shaping of the outer surfaces of the spacers may form further fluid flow channels. Shaping may include the formation of linear, curved, axially extending, helical, etc. surface indentations.

An embodiment of a cutting ring is described in more detail hereinbelow.

With reference additionally to FIGS. 5 to 7, a possible cutting ring is shown. Each cutting ring 16 includes the annular outer surface 17 and a bearing surface on its inner facing side on which it rotates to create a roller effect on the tool. In the illustrated embodiment, each cutting ring 16 is capable of in-plane rotation and has a bearing surface 19*a* to allow the ring to rotate in the plane defined through the full circumference of annular outer surface 17. Stated another way, bearing surface 19*a* allows annular outer surface 17 to rotate about axis x1. The ring also has inner diameter surface 19*b*, which can act as another possible bearing surface if desired. Surface 19*b* would allow annular outer surface 17, and in fact the entire ring 16, to rotate about axis x2, if such rotation can be accommodated. As noted above, in the illustrated embodiment of FIGS. 1 to 4, rings 16 and spacers 18 are retained against rotation about section 38 and only annular outer surface 17 of rings rotate about the body 11.

In the illustrated embodiment of FIGS. 5 to 7, ring 16 has a multi-part construction with an outer annular member 22 on which annular outer surface 17 is located and a bearing member, which in this embodiment to facilitate construction of the ring is a combination of two annular members 20, 24. In one embodiment, the three annular members are fit together to form the cutting ring. Outer annular member 22 is installed in the bearing member to have its outer annular surface 17 exposed along with the plurality of cutter heads 26. Annular member 22 can carry the cutter heads in various ways, depending on a number of factors. Any number of cutter heads 26 may be used in the cutting ring. In one embodiment, the number, form and arrangement provides that the cutter heads allow the cutting ring to rotate while the stabilizer moves up or down the wellbore. In this illustrated embodiment, member 22 has a plurality of apertures formed therein for receiving the cutter heads, and heads 26 are exposed in part on outer annular surface 17. In this embodiment, each cutter head 26 is cylindrical in form and is inserted into an aperture in annular member 22. A first end of the cutter head protrudes outwardly beyond the outer surface of annular member 22. This describes the illustrated cutter heads, but other shapes and configurations are possible along with other durable surfaces such as those provided by coatings, treated metals, etc.

Annular member 22 has, opposite the outer surface 17, an inner facing wall 30. Inner facing wall 30 defines the inner perimeter of a substantially circular opening. Inner facing wall 30 defines the surface on which member 22 rides as it rotates on the bearing member. In the illustrated embodiment, the back side of cutter heads 26 protrude onto inner facing wall 30. Because of the hardness of the materials used for cutter heads 26, they may be used, as shown in this embodiment, as the bearings that ride over surface 19*a*.

The bearing member, which is the combination of annular members 20, 24, defines bearing surface 19*a* on its outer surface and inner diameter surface 19*b* on its inner facing surface.

Outer annular member 22 is mounted on bearing surface 19*a*. Bearing surface 19*a* may include a groove 19*a*' that holds the outer annular member in place and allows member 22 to rotate about axis x1 on members 20, 24. Groove 19*a*' may be formed on one side by an indentation on member 24 and may be completed by a side wall formed by member 20. Whatever the construction, bearing surface 19*a* may be selected to accommodate the wear that results from having outer annular member 22 riding thereover. If, for example, as shown herein, cutter heads 26 actually ride over surface 19*a*, then the surface or perhaps all of members 20, 24 may be formed of a material substantially as durable.

It will be appreciated therefore that the multi-part construction, including members 20, 24, facilitates the installation of annular member 22 on the bearing member. Also, replacement and repair of parts is more readily accommodated. For example, all or portions of rings 16 can be replaced readily with each run of the stabilizer to ensure that the rings are always in acceptable condition.

Inner diameter surface 19*b* of the bearing member is configured to allow installation of cutting ring 16 on mandrel 12. Surface may be selected to accommodate or, alternately, stop rotation of the ring 16 about axis x2. In any event, inner diameter surface 19*b* has an inner diameter sized to fit over section 38 of mandrel 12. In this embodiment, surface 19*b* is selected to orient surface 17 on an angle relative to the long axis x of section and so surface 19*b* is a substantially cylindrical bore with axis x2 offset from (non-parallel with) the axis x1 about which the bearing surface 19*a* extends. Thus, bearing surface 19*b* and its axis x2 extends non-orthogonally relative to a plane orthogonal with bearing surface 19*a* and axis x1.

In the illustrated embodiment, end faces 34, 36 of the cutting ring 16 are substantially orthogonal to bearing surface 19*a* and axis x1. Because surface 19*b* passes at an angle through the thickness of the ring from face 34 to face 36, the openings to inner diameter surface 19*b* on faces 34, 36 each become elliptically shaped.

To assemble stabilizer 10, cutting rings 16 are positioned on the tool body with the cutting rings encircling the mandrel. The rings, if non-orthogonally angled, have a portion tilted toward one end of the tool body. This means that a plane through the body of the ring is non-orthogonal relative to the long axis x of the tool body. Cutting rings 16 are capable of rotating when installed on the tool body so that they may act as rollers on the tool.

In the illustrated embodiment of FIGS. 1 to 7, rings 16 are first assembled. This assembly positions outer annular member 22 against bearing surface 19*a* so that free rotation is permitted between member 22 and the bearing member provided by members 20, 24.

Rings 16 and spacers 18 are then placed on to section 38 in an alternating sequence. The cutting rings encircle at least a portion of the outer surface of section 38 with bearing surface 19*b* open to section 38. Adjacent cutting rings carried on section 38 are separated by at least one spacer 18. End fitting 14 may then be connected onto mandrel 12 to hold the spacers and rings in place between shoulders 40, 41. Cutting rings 16 may act as rollers on the tool and around the circumference of the tool the largest outer diameter of the rings at cutter heads 26, when installed on tool 10, may be greater than Du so that the cutters extend radially out beyond the other stabilizer components, including the largest diameter outer surface of the stabilizer.

In a sample embodiment, first spacer 18*a* is slid on to section 38. One end 18''' of the first spacer is cut substantially perpendicular to the long axis x of mandrel 12, as is shoulder 40 so these parts come together with a close fit. The other end 18' of the first spacer is cut such that its plane intersects the long axis of upper tool body sub 12 at an angle. In one embodiment, the plane of the second face of the first spacer intersects at an angle of approximately 45° with the long axis of the upper tool body sub 12. The diameter of the inner bore through the first spacer is smaller than the outer diameter $D_U$ of the end of mandrel 12, such that the first spacer cannot be removed from the mandrel at that end. In one embodiment, it is shoulder 40 that prevents first spacer 18*a* from sliding above a certain point on mandrel 12 and the first spacer is maintained on section 38.

A first cutting ring 16*a* is then placed on to section 38 adjacent to first spacer 18*a* and section 38 extends through the inner bore of the ring, which is defined by inner diameter surface 19*b*. As will be appreciated, with this installation, section 38 passes through the planes defined at end faces 34, 36 of the ring. While the planes at end faces 34, 36 may be at various orientations relative to the long axis x, as noted, the illustrated axis x2 through surface 19*b* is inclined such that when cutting ring 16*a* is placed onto section 38 with bearing surface 19*b* facing the outer surface of section 38, the planes of the first and second end faces 34, 36 of the first cutting ring intersect the long axis x through mandrel 12 at an angle. In one embodiment, the planes of the first and second faces 34, 36 intersect the long axis x of mandrel 12 at an angle of approximately 45°.

The slope of the end face 18' of first spacer 18*a* is substantially the same as the slope of the end face of the first cutting ring 16*a*, such that when the first cutting ring is adjacent to the first spacer, the end faces of the two components are in substantial contact with each other.

Thereafter, further spacers 18*b*, 18*c* and 18*d* and rings 16*b*, 16*c* and placed on to section 38. A spacer is placed between each adjacent pair of rings. The final spacer 18*d* is sleeved onto section against the last placed ring 16*c*. Thereafter, end fitting 14 is threaded onto mandrel 12 to position shoulder 41 against end 18''' of spacer 18*d*. As noted above, with respect to spacer 18*a* and shoulder 40, end 18''' of spacer 18*d* and shoulder 41 are likewise formed orthogonally so that they extend at an angle substantially perpendicular to the axis x of the mandrel. While this could permit rotation between spacer 18*d* and shoulder 41, in this embodiment, end fitting 14 is threaded tight onto mandrel 12 to compress the spacers and the rings tightly between shoulders 40, 41 and hold them against rotation.

The end faces 34, 36 of rings 16 and ends 18' of spacers 18 each interlock, as by having corresponding slopes that fit together. Thus, a sleeve type arrangement is formed of spacers and rings.

Rings 16 act as rollers on the stabilizer. In particular, outer annular member 22 of each ring 16 can rotate about axis x1 on bearing surface 19*a*. In this embodiment, axis x1 is not parallel with axis x of the mandrel. Axis x1 may or may not intersect with the long axis x of the tool.

Although an orthogonal orientation is possible, in this embodiment, each ring is tilted on the mandrel at a non-orthogonal angle, which can vary but is illustrated as being about 45°. The angle of each ring is further rotated relative to the rings adjacent to it. Thus, for example, first ring 16*a* is angled at 45° relative to axis x of the mandrel and thus has one portion ya that is closest to end 12*a* and second ring 16*b* is angled at 45° relative to axis x of the mandrel and thus has one portion yb that is closest to end 12*a*. In this embodiment, ya is offset from point yb of the second ring by a clockwise (or counterclockwise) rotation of approximately 120° about the long axis of the mandrel. Since end 12*a* is the likely upper end of the tool as it is installed in the string, point ya of ring 16*a* and point yb of ring 16*b* each become the trailing ends of those rings.

Likewise the trailing end of ring 16*c* may be offset from the trailing end of ring 16*c*.

In the above described embodiment, each of the three cutting rings is tilted at about 45° and offset from the other two by a rotation of approximately 120° about the long axis of mandrel 12, but these angles and rotations can be varied as noted above. Likewise, three rings and four spacers are shown, but these can be varied.

In use, stabilizer 10 is installed in a drill string with tubulars connected at its ends 12*a*, 14*b*, as by threaded connections. The stabilizer is moved with the drill string as it advances. Cutting rings 16 protrude beyond the outer diameter $D_U$, $D_L$ of the tool body including mandrel 12 and end fitting 14. Rings 16, therefore, preferentially contact the wellbore wall to stabilize the tool, and thereby the string, in the wellbore being formed. Cutting rings 16 rotate about the tool body and, thereby, act as rollers. In this embodiment cutting rings 16 can rotate about an axis offset from with the long axis of the stabilizer, which is parallel or coaxial with the axis of rotation of the drill string. The rotations of the cutting ring may or may not intersect with the long axis of the stabilizer and/or the axis of rotation of the drill string. The rotations of the cutting rings and the spacing effected by the cutting rings of the stabilizers outer surface away from the wellbore wall, reduce torque and drag on the drill string as it advances.

As the drill string is advanced, the drill string may be rotated. When this occurs, body 11 is rotated with the drill string because of the end connections. Rings 16 may remain stationary as body 11 rotates therewithin or rings 16 may rotate to some extent with the body. In some embodiments, body 11 can rotate within rings 16, as provided annular member 22 riding over bearing surface 19*a*.

Rings 16, will be moved axially through the wellbore, along with the string as it advances and cutters 26 can scrape along the wellbore wall. If one ring 16 contacts at a single point on wall, that ring may rotate to some degree about axis x1.

Cutter heads 26 bear against the wellbore wall and cut it to gauge. A plurality of spaced-apart cutting rings along the length of the stabilizer provides a longer crown length (i.e. contact length with the wellbore wall) than using a single cutting ring. The longer crown length may assist in reducing torque and/or drag.

Further, one cutting ring, which has a circular outer surface 17 and is mounted having the plane through its outer surface inclined relative to the long axis of the stabilizer and/or the axis of rotation of the drill string, provides two points that protrude out from the outer surface of the stabilizer to the greatest degree. These points are the most likely points of contact between the cutting ring and the inner wellbore wall. These points of contact are diametrically opposed points on each inclined ring and are at the mid points between the leading end and trailing end of each ring where the circle of the outer surface 17 protrudes out more from the outer surface circumference of the stabilizer than at the other points along outer surface 17. Each additional inclined cutting ring, being rotationally offset from other cutting rings on the stabilizer, potentially provides two additional contact points, such that at any one time there are at least two contact points per inclined ring between the stabilizer and the wellbore wall. For example, a stabilizer having three cutting rings with their faces angled relative to the long axis of the stabilizer, and the rings being offset from each other by a rotation of about 120° about the long axis, comes into contact with the wellbore wall at up to six points at any given time (i.e. two contact points per ring). In such an embodiment, a stabilizer with an outer circumference when viewed from the end along the long axis x, has contact points at 0°, 60°, 120°, 180°, 240° and 300°, with the contact points at 0° and 180° provided by one ring, the contact points at 60° and 240° provided by the second ring and the contact points at 120° and 300° provided by the third ring. Each of these sets of contact points are spaced apart along the length of the tool, the spacing distance equal to the distance between each adjacent ring.

Spacing between adjacent cutting rings and between cutter heads may enhance fluid flow upwardly past the stabilizer. The angling and offsetting of the cutting rings on the stabilizer may further enhance this flow. Fluid flow may follow a helical or tortuous path, wherein fluids circle the tool to bypass each ring at its uphole, trailing end (ya, yb). Indentations on spacers 18, such as thinner areas 18", channel the fluid through the spaces between rings 16.

The stabilizer may allow the drill string to rotate with minimal frictional engagement with the wellbore wall. By providing a number of contact points between the cutter heads and the wellbore wall, the stabilizer may reduce drag of the drill string against the wellbore wall, thereby assisting the drill string in sliding downward in the wellbore. The inclusion of cutting rings that are inclined relative to the long axis of the stabilizer and/or axis of rotation of the drill string allows the stabilizer to interact with the maximum inner diameter of the wellbore, while providing a flow-by area for the upward flow of drilling mud and wellbore cuttings in the annulus.

One or more stabilizers 10 can be installed in the drill string at adjacent or spaced apart locations.

After the wellbore is drilled, the string may be tripped to surface. The stabilizer may be removed from the string and prepared for further use. If the cutter heads or any portion of the rings are worn, the stabilizer may be disassembled readily by disconnecting the end fitting, removing the rings from section 38. Because the rings are simply slid over section 38, they may be readily removed and replaced while maintaining the integrity of other parts so that they may be immediately reused.

The tool body subs, the annular members of the cutting rings, and the spacers may be constructed of any suitable material capable of withstanding downhole rigors and will most often be metals such as steel, carbides. The cutter heads are made of hard materials, including for example tungsten carbide and other carbides.

In view of the above-described stabilizer, a method is therefore provided for facilitating the downhole movement of a drill string in a wellbore. The method comprises attaching the ends of a stabilizer to the drill string, the stabilizer comprising a body having an inner surface defining an axially extending bore and an outer surface; at least one cutting ring having a durable surface on its outer perimeter, the cutting ring being carried on a portion of the outer surface of the body at a location along the length of the body and encircling the long axis of the body. The method further comprises placing the stabilizer with the drill string in the wellbore. In one embodiment of the method, the cutter ring acts as a roller, being capable of rotating about the long axis of the body and the stabilizer rolls on the cutting ring. In one embodiment, the stabilizer of the method has the cutting ring angled relative to the long axis of the tool body and in another embodiment, the stabilizer comprises at least two cutting rings, the at least two cutting rings being rotationally offset from each other.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. For US patent properties, it is noted that no claim element is to be construed under the provisions of 35 USC 112, sixth paragraph, unless the element is expressly recited using the phrase "means for" or "step for".

I claim:

1. A stabilizer for use in a wellbore string, comprising:

an elongate body having an upper end for connection to the wellbore string and a lower end for connection to the wellbore string, the elongate body having a long axis x1 between the ends and an outer surface; and a first annular cutting ring coaxially mounted on the elongate body and in direct contact with the outer surface of the body, the annular cutting ring defining:

an annular outer surface, the outer surface defining a first plane therethrough, and providing, at any one time, two diametrically opposed points of contact with a wellbore wall, and an inner surface, the inner surface forming a substantially cylindrical central bore rotatable around the long axis x1, the inner surface orienting the first plane of the outer surface at a non-orthogonal angle relative to the long axis x1.

2. The stabilizer of claim 1 wherein the annular outer surface includes a durable material capable of resisting wear when in contact with the wellbore wall to a greater extent than the other material of the first cutting ring.

3. The stabilizer of claim 2 wherein the durable material includes a plurality of cutters.

4. The stabilizer of claim 1 wherein the annular outer surface protrudes radially outwardly from the outer surface of the elongate body at at least two diametrically opposed points.

5. The stabilizer of claim 1 wherein the first cutting ring operates as a roller.

6. The stabilizer of claim 1 wherein the first cutting ring rotates about the long axis x1.

7. The stabilizer of claim 1 wherein the first cutting ring rotates coaxially or off-axis relative to the long axis x1 of the elongate body.

8. The stabilizer of claim 1 wherein the elongate body includes an inner bore extending between the upper end and the lower end.

9. The stabilizer of claim 1 wherein the upper end and the lower end are threaded connections.

10. The stabilizer of claim 1 wherein the elongate body includes a mandrel and the first cutter ring is installed on the mandrel between a pair of shoulders.

11. The stabilizer of claim 1 wherein the non-orthogonal angle is from 10° up to 90°.

12. The stabilizer of claim 11 wherein the non-orthogonal angle is from 20° to 70°.

13. The stabilizer of claim 1 further comprising at least a second cutting ring coaxially mounted on the elongate body and exposed directly on the outer surface, and having an outer annular surface defining a second plane therethrough.

14. The stabilizer of claim 13 wherein the second cutting ring is positioned non-orthogonally relative to the long axis x1.

15. The stabilizer of claim 13 wherein the first plane defined through the outer annular surface of the first cutting ring is not parallel with the second plane defined through the outer annular surface of the second cutting ring.

16. The stabilizer of claim 15 further comprising a spacer between the first cutting ring and the second cutting ring.

17. The stabilizer of claim 16 wherein the spacer has a surface indentation creating a fluid flow channel.

18. The stabilizer of claim 16 wherein the spacer interlocks with the first cutting ring and the second cutting ring.

19. The stabilizer of claim 13 wherein the first plane is offset from the second plane by a rotation of up to 180°.

20. The stabilizer of claim 1 wherein the first cutting ring includes a bearing surface on an inner facing side opposite the annular outer surface, the first cutting ring rotating on the bearing surface to create a roller effect on the elongate body.

21. A method for stabilizing a drill string in a wellbore, the method comprising:

running in a drill string with a stabilizer, the stabilizer including an elongate body having, an upper end connected to an upper portion of the drill string and a lower end connected to a lower portion of the drill string, the elongate body having a long axis x1 between the ends substantially coaxial with an axis of rotation of the drill string; and a first annular cutting ring coaxially mounted on, and in direct contact with, the first cutting ring defining:

an annular outer surface, the outer surface having a first plane defined therethrough, and an inner surface, the inner surface forming a substantially cylindrical central bore rotatable around the long axis x1, the inner surface orienting the first plane at a non-orthogonal angle relative to the long axis x1; and supporting the drill string in the wellbore with the first cutting ring providing, at any one time, two diametrically opposed contact points against a wall of the wellbore.

22. The method of claim 21 wherein supporting includes rotating the first cutting ring about the long axis x1 as it bears against the wall.

23. The method of claim 21 wherein supporting including spacing the outer surface from the wellbore wall.

24. The method of claim 21 wherein supporting includes a plurality of further cutting rings contacting the wall, at any one time, at two further diametrically opposed contact points.

25. The method of claim 21 further comprising circulating fluid upwardly past the stabilizer, the fluid flowing along the first cutting ring to a trailing end and passing over the first cutting ring toward the upper end.

26. The method of claim 21 further comprising rotating the drill string and the elongate body rotating within the first cutting ring.

* * * * *